343-700 MS AU 251 EX
3/31/87 OR 4,654,668

United States Patent [19]

Schwartz et al.

[11] Patent Number: 4,654,668

[45] Date of Patent: Mar. 31, 1987

[54] MICROSTRIP CIRCUIT TEMPERATURE COMPENSATION WITH STUB MEANS

[75] Inventors: Leonard Schwartz, Montville, N.J.; Emile J. Deveau, Pleasantville, N.Y.

[73] Assignee: The Singer Company, Little Falls, N.J.

[21] Appl. No.: 719,857

[22] Filed: Apr. 3, 1985

[51] Int. Cl.[4] ..... H01Q 1/38
[52] U.S. Cl. ..... 343/700 MS; 333/246
[58] Field of Search ..... 343/700 MS, 829, 846, 343/905; 333/238, 155, 246, 116

[56] References Cited

U.S. PATENT DOCUMENTS

| | | | |
|---|---|---|---|
| 2,819,452 | 1/1958 | Arditi et al. | 333/238 |
| 3,534,301 | 10/1970 | Golembeski | 333/246 |
| 4,079,268 | 3/1978 | Fletcher et al. | 343/700 MS |
| 4,296,416 | 10/1981 | Harader | 343/846 |

*Primary Examiner*—Eli Lieberman
*Assistant Examiner*—Michael C. Wimer
*Attorney, Agent, or Firm*—Thomas W. Kennedy

[57] ABSTRACT

In order to achieve temperature compensation in a microstrip linear array, the array is periodically loaded by means of a plurality of open circuited stubs coupled to the main transmission line through tightly controlled gap dimensions to provide increasing shunt susceptance which compensates for the decease in shunt susceptance of the line as temperature increases.

5 Claims, 7 Drawing Figures

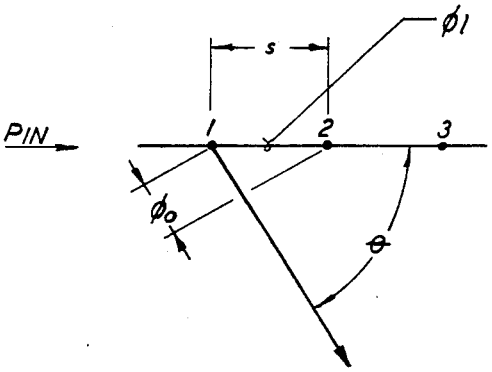

FIG. 1

BEAM DIRECTION DETERMINED BY:

$\phi_o - \phi_l = 2 N \pi$ $\phi_o = \beta_o s \cos \theta$ $\phi_l = \beta_l l$ $\beta_o$ = FREE SPACE PHASE CONSTANT $= 2\pi/\lambda$ $\beta_l$ = PHASE CONSTANT OF LINE BETWEEN ELEMENTS $= 2\pi/\lambda_\epsilon = \frac{2\pi\sqrt{\epsilon}}{\lambda}$ $l$ = LENGTH OF LINE CONNECTING ELEMENTS $\epsilon$ = DIELECTRIC CONSTANT OF TEM LINE MATERIAL

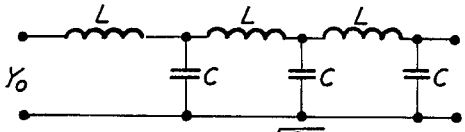

FIG. 2

$Y_o = \sqrt{\frac{C}{L}}$ $\beta_l = \omega\sqrt{LC} = \sqrt{X_L B_C}$

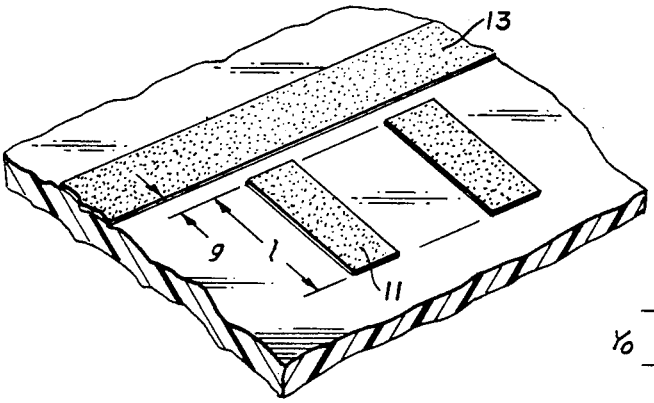

FIG. 3

EQUIVALENT CIRCUIT OF TEM LINE WITH PERIODIC OPEN CIRCUIT O.C. STUB LOADING $Y_{IN} (\frac{1}{a^2})(j Y_o \tan \beta_l l)$

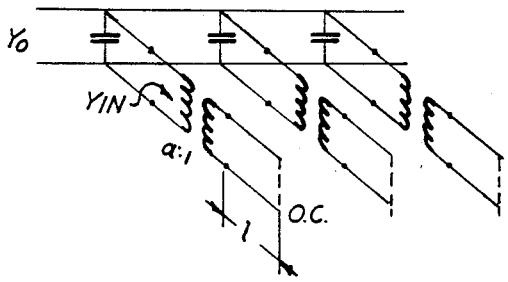

FIG. 4

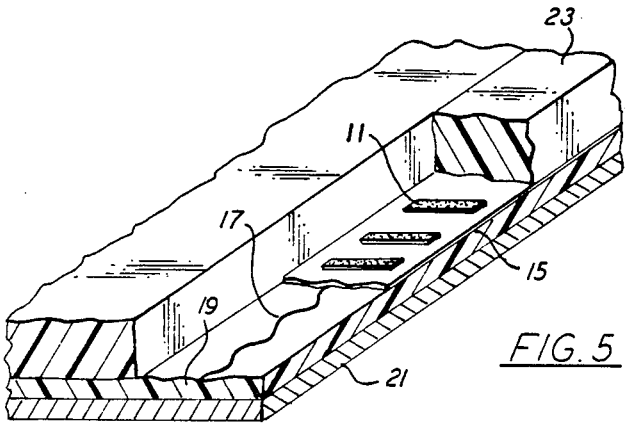

FIG. 5

MICROSTRIP CIRCUIT TEMPERATURE COMPENSATION WITH STUB MEANS

This invention relates to microstrip linear arrays utilized in Doppler navigation systems in general and more particularly to temperature compensation in such linear arrays.

U.S. Pat. No. 4,347,516 discloses one type of antenna employing microstrip radiators.

It has been found however, that such antennas exhibit shifts in beam angles. The variation of the dielectric constant [$\epsilon$] of the microstrip substrate material as a function of temperature has been identified as the major cause of large shifts of beam angles in microstrip arrays. In some cases it is possible to correct for beam angle temperature dependence, not in the antenna itself, but elsewhere in the Doppler system. In other words it is possible to apply a temperature correction to the critical data. In other applications, novel antenna configurations can minimize the system impact while tolerating the beam angle changes. However, it is still desirable to achieve inherent temperature compensation of a microstrip linear array. Through successful temperature compensation of the microstrip linear array certain antenna design constraints with respect to array configuration can be relieved, Teflon substrate materials which have desirable electrical and mechanical properties can be used and the need for additional temperature correcting circuitry is obviated.

It is thus the object of the present invention to provide such temperature compensation of microstrip linear array.

SUMMARY OF THE INVENTION

The present invention provides a solution to this problem through periodic loading of the linear array. This is accomplished by incorporating loading circuitry directly on an etched antenna circuit board and is feasible for both linear feed-line arrays as well as radiating arrays. In general terms, the periodic loading is provided by coupling to the transmission line an increasing shunt susceptance which will compensate for a decreasing shunt susceptance of the line which occurs due to increasing temperature. As illustrated below this can be accomplished through an open circuited stub coupled to the main transmission line through a tightly controlled gap dimension which controls the coupling ratio.

BRIEF DESCRIPTION OF THE DRAWING

FIG. 1 is a drawing illustrating the parameters in a linear array.

FIG. 2 is a schematic diagram illustrating the equivalent circuit of a lossless TEM transmission line.

FIG. 3 is a perspective view of a microstrip line with periodic loading accomplished by means of open circuit stubs.

FIG. 4 is a schematic diagram of the equivalent circuits a line compensating stubs.

FIG. 5 is a perspective view of an antenna having a stub compensation strip installed as an overlay.

DETAILED DESCRIPTION OF THE INVENTION

Theory of Operation

Figure 6:
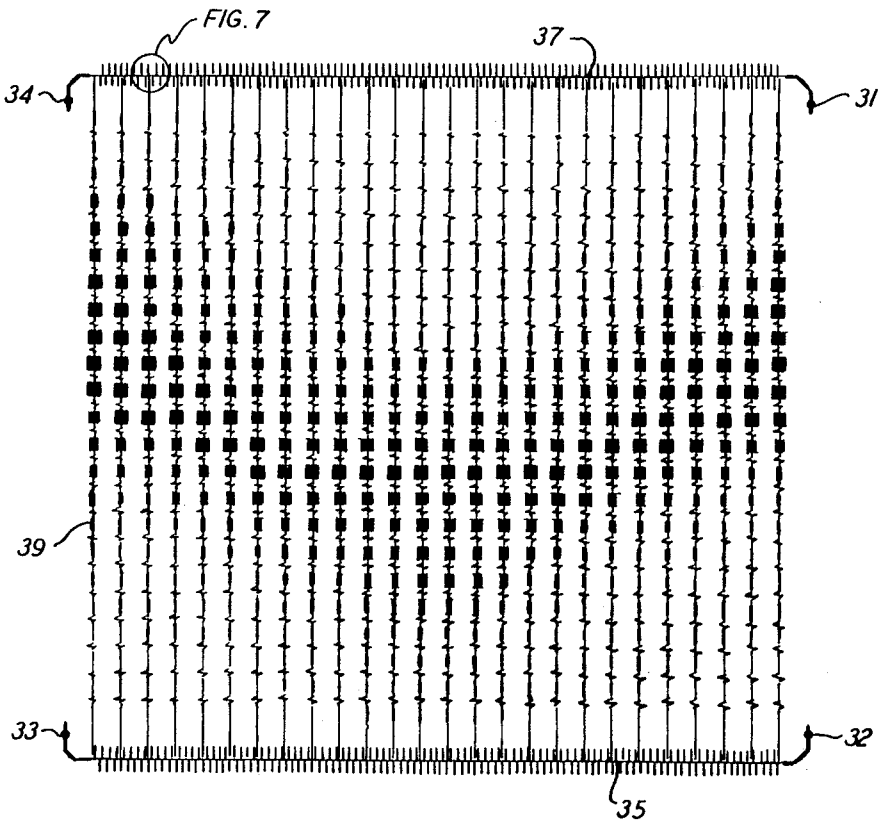
FIG. 6 is a plan view of the artwork for temperature compensated antenna according to the present invention.

The beam angle of a linear array of equally spaced elements is related to the phase shift in the line connecting the elements and therefore to the phase constant (phase shift per unit length) of the line. The simplified relation is shown in FIG. 1. This phase constant for an ideal loss-less, distortion-less TEM line is:

$$\beta_1 = \frac{2\pi}{\lambda} \sqrt{\mu\epsilon} = \omega\sqrt{LC}$$

where L and C are the distributed line inductance and capacitance per unit length, $\mu$ and $\epsilon$ are the relative permeability and permittivity of the transmission medium, and is free space wavelength. The equivalent circuit for such a line is shown in FIG. 2. The change in phase constant of this line arises primarily from a change in the distributed capacitance C, (or shunt susceptance $B=\omega\sqrt{C}$) according to the general relationship $$C=AD\epsilon$$

where A is a constant, D is a function of the line dimensions and $\epsilon$ is a relative dielectric constant. As the $\epsilon$ of substrate material decreases with increasing temperature, C decreases, the shunt capactive susceptance of the line decreases, and the phase constant $\beta_1$ decreases.

The objective of periodic loading, therefore, is to couple to the transmission line an increasing shunt susceptance which will compensate for the decrease in shunt susceptance of the line. An arrangement which has at least partially accomplished this is shown in FIG. 3. In this arrangement an open circuited stub 11 is coupled to the main transmission line 13 through a tightly controlled gap dimension g. The gap dimension controls the coupling ratio $a^2$. The admittance coupled to the line is:

$$Y_{in} = \left(\frac{1}{a^2}\right) (jY_0 \tan\beta_1)$$

and the equivalent circuit is shown in FIG. 4.

EXPERIMENTAL RESULTS

Example 1—Overlay of Compensation Stubs

The first implementation of periodic loading was carried out on an antenna having a typical beam shift for a forward-fire feed array of approximately 0.02 °/°C., and a back-fire feed array of approximately 0.018 °/°C.

Periodic loading of the feed arrays was incorporated as shown in FIG. 5. An overlay 15 of short stubs 11 was etched on a thin G-10 substrate and placed in close proximity to the feed-line 17 of the antenna. As illustrated by FIG. 5, the feed-line 17 is formed on a dielectric substrate 19 which is bonded to a ground plane 21. Covering the dielectric substrate 19 and the compensation strip 15 is a dielectric radome 23.

The length of the stubs 11 on the compensating grid was determined experimentally. A length of 0.105 inches and width of 0.020 inches was found to work well. The compensating strips were then covered by the teflon-fiberglass radome 23 and held in place by an aluminum retaining plate.

The results of beam angle data vs temperature showed change of 0.011 °/°C. on the forward-fire feed array and 0.008 °/°C. on the back-fire feed array. These improvements indicate an average reduction of 56% in the change of the feed-line phase constant versus temperature.

Example 2—Etched Compensating Stubs

Based on the successful results of Example 1 a set of compensating stubs were incorporated directly into the artwork for another antenna. The stub lengths and critical gap dimensions were determined experimentally by making measurements of phase shift vs temperature on a number of feed-line test pieces. The resulting feed-line configurations are illustrated in FIG. 6. In this configuration, the length of the stubs was 0.085, the width 0.020 and the gap dimension 0.005 inches.

Figure 7:
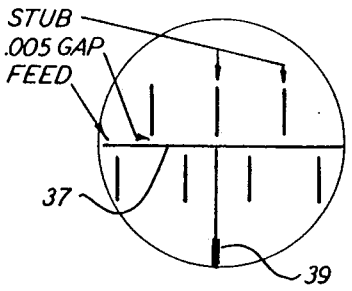
FIG. 7 is a detail of the stubs in the embodiment of FIG. 6.

As is evident, the array of FIG. 6 is essentially of the type described in the aforementioned U.S. Pat. No. 4,347,516. It includes ports 31 through 34 at its corners in turn coupled to feed-lines 35 and 37 between which the linear arrays 39 are connected. Stubs are positioned, as shown in FIG. 7, on each side of the feed-line 37 at equal spacing. Each space between adjacent stubs 11 is approximately equal to one-quarter of the spacing between linear arrays 39 in FIG. 7. The series of stubs 11 on one side of feed-line 37 are alternately positioned relative to the series of stubs 11 on the other side of feed-line 37.

Details of stubs associated with the feed-line 37 are illustrated in FIG. 7. As indicated there is a 0.005 inch gap provided between the stub and the feed-line.

What is claimed is:

1. A method of achieving temperature compensation in a microstrip linear array comprising a transmission line with a plurality of radiating elements extending normal thereto and selectively spaced therealong in which the array is etched on a dielectric substrate with a conductor pattern comprising the step of periodically loading the transmission line, wherein said step of loading comprises coupling to the transmission line stub means for increasing shunt susceptance which will compensate for the decrease in shunt susceptance of the transmission line as temperature increases.

2. The method according to claim 1 wherein the step of coupling stub means for increasing shunt susceptance includes the step of forming open circuited stubs on said substrate adjacent to and extending normal to and coupled to said transmission line through a tightly controlled gap dimension between each stub and the transmission line.

3. In a linear array antenna including a dielectric substrate and a plurality of radiating arrays extending normal to and selectively spaced along a transmission line formed on said substrate, the improvement comprising a plurality of selectively spaced stubs extending normal to and disposed adjacent to said transmission line with a closely controlled gap spacing between each stub and the transmission line, said stubs providing periodic loading of said transmission line to provide temperature compensation.

4. Apparatus according to claim 3 wherein said antenna comprises a dielectric substrate having said arrays etched thereon and wherein said stubs are also etched on said substrate.

5. Apparatus according to claim 3 wherein said arrays are etched on a first substrate and wherein said stubs are etched on a further dielectric substrate, said further dielectric substrate disposed as an overlay over said first substrate.

* * * * *